US005447102A

United States Patent [19]

Pfeiffer et al.

[11] Patent Number: 5,447,102

[45] Date of Patent: Sep. 5, 1995

[54] PROCESS FOR OPERATING A PRINTING PRESS

[75] Inventors: Nikolaus Pfeiffer, Heidelberg; Manfred Schneider, Bad Rappenau, both of Germany

[73] Assignee: Heidelberger Druckmaschinen Aktiengesellschaft, Heidelberg, Germany

[21] Appl. No.: 226,820

[22] Filed: Apr. 12, 1994

[30] Foreign Application Priority Data

Apr. 14, 1993 [DE] Germany ..... 43 12 229.9

[51] Int. Cl.[6] ..... B41F 35/00

[52] U.S. Cl. ..... 101/492; 101/148; 101/349; 101/425; 15/256.51

[58] Field of Search ..... 101/492, 423, 424, 425, 101/484, 350, 349, 348, 365; 15/256.51, 148

[56] References Cited

U.S. PATENT DOCUMENTS

| | | | |
|---|---|---|---|
| 3,673,959 | 7/1972 | Jezuit et al. | 101/148 |
| 3,771,446 | 11/1973 | Kaneko et al. | 101/425 |
| 3,805,700 | 4/1974 | Chambon | 101/148 |
| 4,353,299 | 10/1982 | Murai et al. | 101/425 |
| 4,660,470 | 4/1987 | Kramp et al. . | |
| 4,722,273 | 2/1988 | Jahn | 101/425 |
| 4,967,664 | 11/1990 | Iijima | 101/425 |
| 5,010,820 | 4/1991 | Löffler | 101/350 |
| 5,046,416 | 9/1991 | Freyer et al. | 101/349 |
| 5,174,209 | 12/1992 | Rodi et al. | 101/425 |
| 5,259,313 | 11/1993 | Gibson et al. | 15/256.51 |
| 5,275,104 | 1/1994 | Corrado et al. | 101/425 |
| 5,277,112 | 1/1994 | Ohta et al. | 101/425 |
| 5,325,780 | 7/1994 | Matsuda et al. | 101/425 |

FOREIGN PATENT DOCUMENTS

| | | | |
|---|---|---|---|
| 0450155 | 10/1991 | European Pat. Off. . | |
| 3338143 | 5/1985 | Germany . | |
| 3707695 | 9/1988 | Germany . | |
| 4011039 | 10/1991 | Germany . | |
| 4013465 | 10/1991 | Germany . | |
| 0022950 | 1/1986 | Japan | 101/423 |
| 2077660 | 12/1981 | United Kingdom | 101/425 |
| 0236052 | 5/1986 | United Kingdom | 101/425 |
| 2233603 | 1/1991 | United Kingdom . | |

*Primary Examiner*—Eugene H. Eickholt
*Attorney, Agent, or Firm*—Nils H. Ljungman & Associates

[57] ABSTRACT

Operation of printing presses can typically require that various printing jobs be performed consecutively, or that is, one printing job may need to be performed immediately after a previous printing job is completed. Such printing operations can preferably be conducted, without a complete shutdown of the press, by providing a transitional, or changeover operation during which the various settings for the printing press can be changed from the previous settings to settings needed for the subsequent printing job.

20 Claims, 4 Drawing Sheets

PROCESS FOR OPERATING A PRINTING PRESS

BACKGROUND OF THE INVENTION

1. Field of the Invention

The present invention relates to printing presses, and more particularly, to a process for operating a printing press to print simultaneous print jobs wherein the first print job requires a first printing plate, sheet format, and ink zone profile, and the second print job can require a different printing plate, sheet format and ink zone profile.

2. Background Information

In the printing industry, a printer often needs to produce printing runs simultaneously in order to meet customers needs. However, such simultaneous printing jobs can therefore require a relatively quick changeover from the settings for a first print job to the settings for a second print job. Such a changeover can therefore typically require a changing of the printing plate, a changing of the paper, which can be different in size, type, and thickness, and, because of the new printing plate a changing of the ink distribution which gets carried to the printing plate, so that the appropriate amount of color is being applied by the plate. On rotary printing presses, particularly on offset rotary printing presses, it is necessary to feed a very thin and uniform ink film to a printing plate wetted by a wetting agent. For the high-viscosity printing inks normally used, a complex inking unit equipped with many rollers is generally required to produce this thin and uniform ink film. A result of the high viscosity of the inks being used and the many rollers employed in the inking unit is that it takes longer to achieve an appropriate ink distribution in the inking unit to ready the press for printing. This is especially true during a changeover from a first print job to a second print job requiring a different ink distribution from the distribution in the first job.

One process for building up an ink profile for a new print job in an inking unit of a rotary printing machine is known from the German Patent 37 07 695 C2, which corresponds to U.S. Pat. No. 5,010,820. With the solution disclosed therein, the ink available in the inking unit after a printing run is completed is returned back to the ink fountain by means of a certain number of rotations, prior to building up a new ink profile in the inking unit for a subsequent print job. Alternatively to returning the ink back to the ink fountain, this known solution suggests that the ink profile of the preceding print job be reduced while the paper is being conveyed, with the new printing plate having already been mounted on the plate cylinder. However, the result thereof is an indefinite reduction of the preceding ink profile as the new printing plate has a different ink profile and is possibly not able to remove excessive ink provided in certain zones. In this case, further machine rotations are generally necessary for reducing excessive ink from the ink zones.

OBJECT OF THE INVENTION

On the basis of the above facts, it is the object of the present invention, when changing print jobs on a rotary printing press, to reduce the old ink profile in a rather short time and to then build up a new profile while requiring only a few inking-unit rotations, in order to be able to start the new print job more quickly.

SUMMARY OF THE INVENTION

According to the present invention, this object can preferably be achieved by means of the process steps as outlined herebelow. First, upon completion of a print job, the vibrator roller of the inking unit can be disengaged from the inking unit. Then, with the vibrator roller disengaged, and the old printing plate still present on the plate cylinder, the impression can be thrown on, the paper run can be started, and a small number of prints can be produced. Such a printing with the vibrator roller disengaged essentially enables the ink left on the rollers to be reduced to a relatively thin, basic ink layer. For example, this basic ink layer can preferably be on the order of about 4 microns to about 5 microns thick. Once the relatively few prints have been made to reduce the ink layer, the paper run can be stopped, the impression can be thrown off, and the blanket can be cleaned. At this juncture, the printing plate of the preceding print job can be replaced by the printing plate for the new print job. For example, while the blanket is being cleaned, the printing plates can be changed. Once the blanket roller has been cleaned, the vibrator roller can be re-engaged with the inking unit and the production of the new ink profile can be started. As such, the ink can then enter the inking unit while the respective rollers are still thrown off. After a few rotations of the inking unit rollers, the impression can be thrown on, and the paper run can be re-started for the new print job.

The essential advantage of this solution provides that a small number of sheets can be printed with the printing plate of the preceding print job until the amounts of ink available in the individual zones, which have been preset according to the respective printing plate, have been used up. In other words, the amount of ink can preferably be reduced until ink is essentially no longer available in the inking unit. As a result thereof, only a uniform basic ink layer of ink will preferably remain in all of the ink zones of the inking unit.

The number of sheets which can be required to be printed to reduce the ink to a basic ink layer essentially depends on the set-up of the inking unit and thus on the type of the machine. For example, for heavier ink distribution zones, more prints would probably be needed to be made in order to reduce the ink layer to the basic layer. In practice, it has been determined that by printing only approximately 15 sheets the ink profile is able to be reduced to a uniform basic layer. This means that the printing of essentially only relatively few waste sheets can leave the press in essentially an ideal starting point for building up a new ink profile for a new print job. Thus, the ink profile of a previous run can essentially be reduced to a basic level in a rather short time while producing only minimum waste. Due to the defined initial state, i.e. the basic state, the new profile will generally not be influenced by the old profile, i.e. the preceding profile, so that only a few rotations of the inking unit can be required to provide the individual zones with the necessary amounts of ink, before starting the new print job.

The application of the inventive process in offset printing provides that in a rotary offset printing machine, the plate cylinder can be supplied with dampening medium upon completion of a print job, that the dampening vibrator roller can be engaged as soon as the ink enters the inking unit, and that the cycle of the dampening vibrator roller can be activated such that the cycles of the ink vibrator roller and the dampening vibrator roller end substantially simultaneously at the end of the ink entry. This contributes to achieving the aforementioned advantages without requiring additional technical measures.

According to an advantageous development of the inventive process, the ink can be removed by simply printing on the blanket without paper being conveyed, and then cleaning the blanket. This process can then be repeated as necessary, a number of times until the basic ink profile is established in the inking unit. Further, the process steps can preferably be integrated in the control system of a printing machine so that, to a large extent, print jobs can be changed essentially completely automatically, that means without the operator having to intervene. Thus, depending on the degree of automation, all of the steps necessary for the changing of print jobs could possibly be integrated into one command. In other words, the steps of:

reducing the old ink profile;
cleaning the blanket;
changing the printing plates;
changing formats; and
ink entry;

could preferably all be carried out automatically after preferably entering only a single command into the printing press control unit.

An advantage of this process is that the operator may start the job changing with preferably one command, and then preferably does not have to carry out a number of different commands. This automation can thereby exclude operating error from the process, and the operator can gain time.

One aspect of the invention resides broadly in a process for operating a printing press to conduct at least first and second printing jobs, the printing press comprising a printing plate cylinder for positioning a printing plate, an ink reservoir for holding a supply of ink and an inking mechanism for transferring the ink between the ink reservoir and the printing plate during operation of the printing press, the inking mechanism comprising a plurality of inking rollers, a plurality of individually adjustable ink zone metering devices disposed in conjunction with the ink reservoir, at least one ink fountain roller positioned adjacent the plurality of individually adjustable ink zone metering devices to receive ink via the metering devices, and at least one ink transfer roller for transferring ink between the ink fountain roller and at least one of the plurality of inking rollers, each of the plurality of individually adjustable ink zone metering devices defining a substantially corresponding ink zone in the printing press, the printing press further comprising sheet feeding apparatus for feeding sheets of printing stock into the printing press, a rubber blanket cylinder having a rubber blanket disposed thereabout for receiving an ink impression from the plate cylinder, a sheet drum for receiving sheets being fed for printing the ink impression of the rubber blanket onto the sheets, apparatus for stacking printed sheets in a pile, and apparatus for transporting printed sheets to the sheet stacking apparatus, the process comprising the steps of: adjusting the plurality of ink zone metering devices to settings appropriate for establishing a first ink zone profile in the printing press; transferring ink from the ink reservoir to the printing plate cylinder via a route of travel which extends from the ink reservoir through at least one of the plurality of individually adjustable ink zone metering devices, thereafter to the at least one ink fountain roller, thereafter to the at least one ink transfer roller, thereafter to the plurality of inking rollers, and thereafter to the printing plate cylinder to establish the first ink zone profile; feeding sheets of printing stock for the first printing job into the printing press to the sheet drum with the sheet feeding apparatus; engaging the rubber blanket cylinder with the plate cylinder, and engaging the sheet drum with the rubber blanket cylinder; transferring ink impressions from the printing plate to the rubber blanket cylinder and then to sheets of printing stock on the sheet drum to produce printed sheets; transporting the printed sheets from the sheet drum to the sheet stacking apparatus with the sheet transport apparatus; stacking the printed sheets into a pile of sheets; terminating the printing of the first printing job; changing over the printing press from the first printing job to the second printing job, the second printing job having an ink zone profile different from the first ink zone profile, and at least the plurality of inking rollers having a residual amount of ink thereon after terminating the first printing job, the changeover process comprising the steps of: interrupting flow of ink from the ink reservoir to the plurality of inking rollers; operating at least the plurality of inking rollers, the plate cylinder and the rubber blanket cylinder to transfer residual ink from the inking rollers to the rubber blanket cylinder; removing residual ink from the blanket cylinder; repeating the steps of operating and removing to remove a substantial portion of the residual ink from at least the plurality of inking rollers; removing the printing plate from the first print job and installing a printing plate for the next print job; adjusting the plurality of ink zone metering devices to settings appropriate for establishing the second ink zone profile of the second printing job; and operating the plurality of inking rollers, the at least one ink transfer roller, and the at least one ink fountain roller to transfer ink from the ink reservoir to the inking rollers to establish the second ink zone profile in the printing press; feeding sheets of printing stock for the second printing job into the printing press to the sheet drum with the sheet feeding apparatus; engaging the plate cylinder with the plurality of inking rollers, engaging the rubber blanket cylinder with plate cylinder, and engaging the sheet drum with the rubber blanket cylinder; transferring ink from the plurality of inking rollers to the printing plate on the plate cylinder to form ink impressions on the printing plate, transferring ink impressions from the printing plate to the rubber blanket cylinder and then from the rubber blanket cylinder to sheets of printing stock on the sheet drum to produce printed sheets; transporting the printed sheets from the sheet drum to the sheet stacking apparatus with the sheet transfer apparatus; stacking the printed sheets into a pile of printed sheets; and terminating the printing of the second printing job.

Another aspect of the invention resides broadly in a process for operating a printing press to change from a first printing job to a second printing, the printing press comprising: a printing plate cylinder for positioning a printing plate, an ink reservoir for holding a supply of ink and an inking mechanism for transferring the ink between the ink reservoir and the printing plate during operation of the printing press, the inking mechanism comprising a plurality of inking rollers, a plurality of individually adjustable ink zone metering devices disposed in conjunction with the ink reservoir, and apparatus for transferring ink between the ink zone metering device and at least one of the plurality of inking rollers, each of the plurality of individually adjustable ink zone metering devices defining a substantially corresponding ink zone in the printing press, the first printing job having a first ink profile, and the second printing job having a second second ink profile, the process comprising changing of the ink profile from the first ink profile to the second ink profile, and the changing of the ink profile comprising the steps of: finishing the printing of the first printing job, at least the plurality of inking rollers having a residual amount of ink thereon after the terminating of the first printing job; interrupting flow of ink from the ink reservoir to the plurality of inking rollers via the apparatus for transferring ink; operating at least the plurality of inking rollers, the plate cylinder and the rubber blanket cylinder to transfer at least a portion of the residual ink from the plurality of inking rollers to the rubber blanket cylinder; removing at least a portion of the residual ink from the blanket cylinder; repeating the steps of operating and removing to remove a substantial portion of the residual ink from at least the plurality of inking rollers; changing printing plates by removing the printing plate from the first printing job and installing a printing plate for the second printing job; adjusting the plurality of ink zone metering devices to settings appropriate for establishing the second ink zone profile of the second printing job; operating the plurality of inking rollers, and the apparatus for transferring ink to transfer ink from the plurality of ink zone metering devices to the plurality of inking rollers to establish the second ink zone profile on the plurality of inking rollers; engaging the plate cylinder with the plurality of inking rollers to transfer ink from the plurality of inking rollers to the printing plate to form an ink impression on the printing plate; and printing the second print job.

BRIEF DESCRIPTION OF THE DRAWINGS

The process according to the present invention will now be described in more detail with reference to the accompanying drawings, in which.

DESCRIPTION OF THE PREFERRED EMBODIMENTS

Figure 1A:
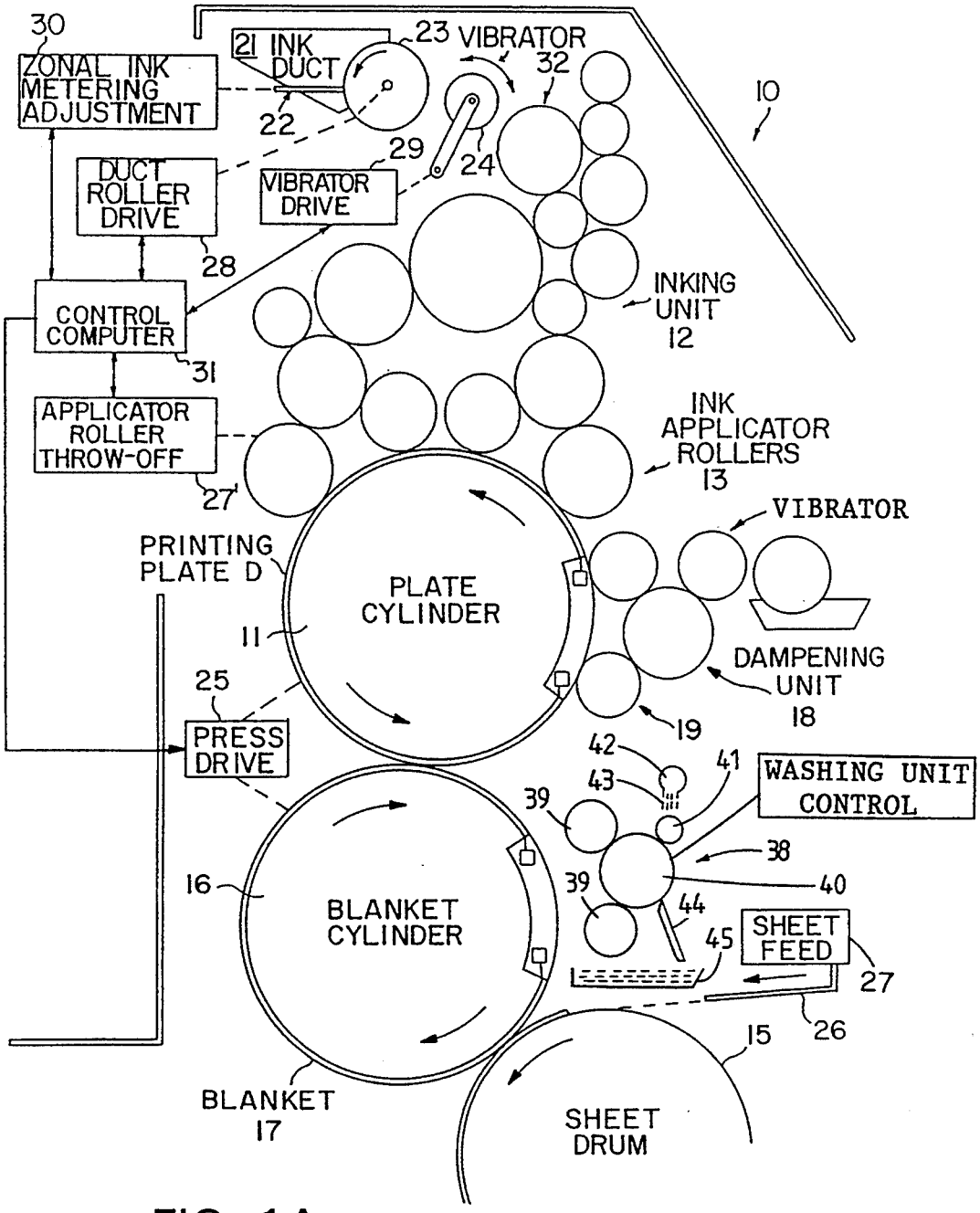
FIG. 1A is a schematic representation of a printing unit of a rotary offset printing press.

FIG. 1A shows one type of a printing unit 10 which can be a part of a rotary printing press. In essence, the components depicted thereby, are generally well known in the art, and are therefore only summarized briefly herebelow. While the embodiment depicted by FIG. 1A shows one type of printing press, the process in accordance with the present invention can be applied to other types of presses as well. In the depicted embodiment, the typical parts of a printing unit 10 can generally include: a plate cylinder 11 having mounted thereon a printing plate D; an inking unit 12 which includes ink applicator rollers 13 for applying to printing plate D, an ink profile of a single color printing ink (for example, black, cyan, magenta or yellow, etc.); a dampening (or wetting) unit 18 having dampening applicator rollers 19 for transferring a dampening agent to printing plate D; a blanket cylinder 16 carrying a rubber blanket 17 for receiving an ink impression from printing plate D; and a sheet drum 15 for carrying a printed sheet 14 onto which the ink impression carried by blanket 17 can be transferred.

It is particularly important that the ink be applied to printing plate D in a precisely defined and controllable manner. That is, those areas of printing plate D having a high density of printed content will generally require a greater ink flow during the printing process than those areas having a lower density of printed content. To this end, the printing unit 10 can typically be provided with a means for zonally varying the ink application profile across the width of the printing unit 10. For example, as shown in FIG. 1A, printing unit 10 may be provided with an ink duct 21 which can preferably extend across the width of the inking unit 10. The zonal adjustment of the ink application profile can be provided by a plurality of ink metering ducts 22, which can preferably be disposed along the length of the ink duct 21, which ducts 22 may be controlled or adjusted by a zonal ink metering adjustment mechanism 30 under the control of a computer 31.

A duct roller 23 can typically be mounted adjacent to ink duct 21. An ink duct of this type is further described in U.S. Pat. No. 3,978,788, issued Sep. 7, 1976, the contents of which are hereby expressly incorporated by reference as if this patent were set forth in its entirety herein.

Typically, the ink application profile which is set up on duct roller 23 can be transferred into the inking unit 12 by means of a vibrator roller 24 which can oscillate to successively pick up strips of ink from duct roller 23 and transfer them into inking unit 12, as for example, by preferably contacting one of the rollers 32 of the inking unit 12. The operation of such a vibrator roller 24 is more fully described in U.S. Pat. No. 3,908,545, issued Sep. 30, 1975, this issued U.S. patent being hereby expressly incorporated by reference as if the contents thereof were set forth fully herein.

Typically, the printing stand 10 can also include auxiliary mechanisms such as, for example, a duct roller drive 28, a vibrator roller drive 29, an applicator roller throw-off 27 for lifting the ink applicator rollers 13 off of the printing plate D, a press drive 25 and a sheet feed 27 for supplying the sheets to be printed 26 to sheet drive drum 15.

In addition, the printing press can be provided with at least one washing apparatus for washing the rollers of the press. As shown in the example of FIG. 1A, such a washing apparatus 38 could preferably be configured to cooperate with the blanket cylinder 16, yet it should be understood that other possible placements can be provided within the printing unit. Washing apparatus 38 can preferably be adapted to be brought into contact with the outer cylindrical surface, i.e. with the rubber blanket 17, of rubber blanket cylinder 16, by the operation of a control device, shown schematically, which, in essence could be controlled by the control computer 31. Washing apparatus 38 can include two washing rollers 39 as well as common roller 40 that connects the two washing rollers 39 together. There could also preferably be a transfer roller 41, which can preferably be in contact with common roller 40 and to which washing liquid 43 can be supplied by either spray apparatus 42, or another similar device. A doctor blade apparatus 44 could be positioned to cooperate with roller 40 to scrape residue from roller 40, and collection trough 45 could be positioned under roller 40 for collecting excess washing liquid and ink residue therein.

The washing of the cylinders, etc. as briefly set forth hereabove, is described in further detail in U.S. Pat. No. 5,174,209, issued Dec. 29, 1992, the contents of which are hereby expressly incorporated by reference as if this patent were set forth in its entirety herein.

Figure 2:
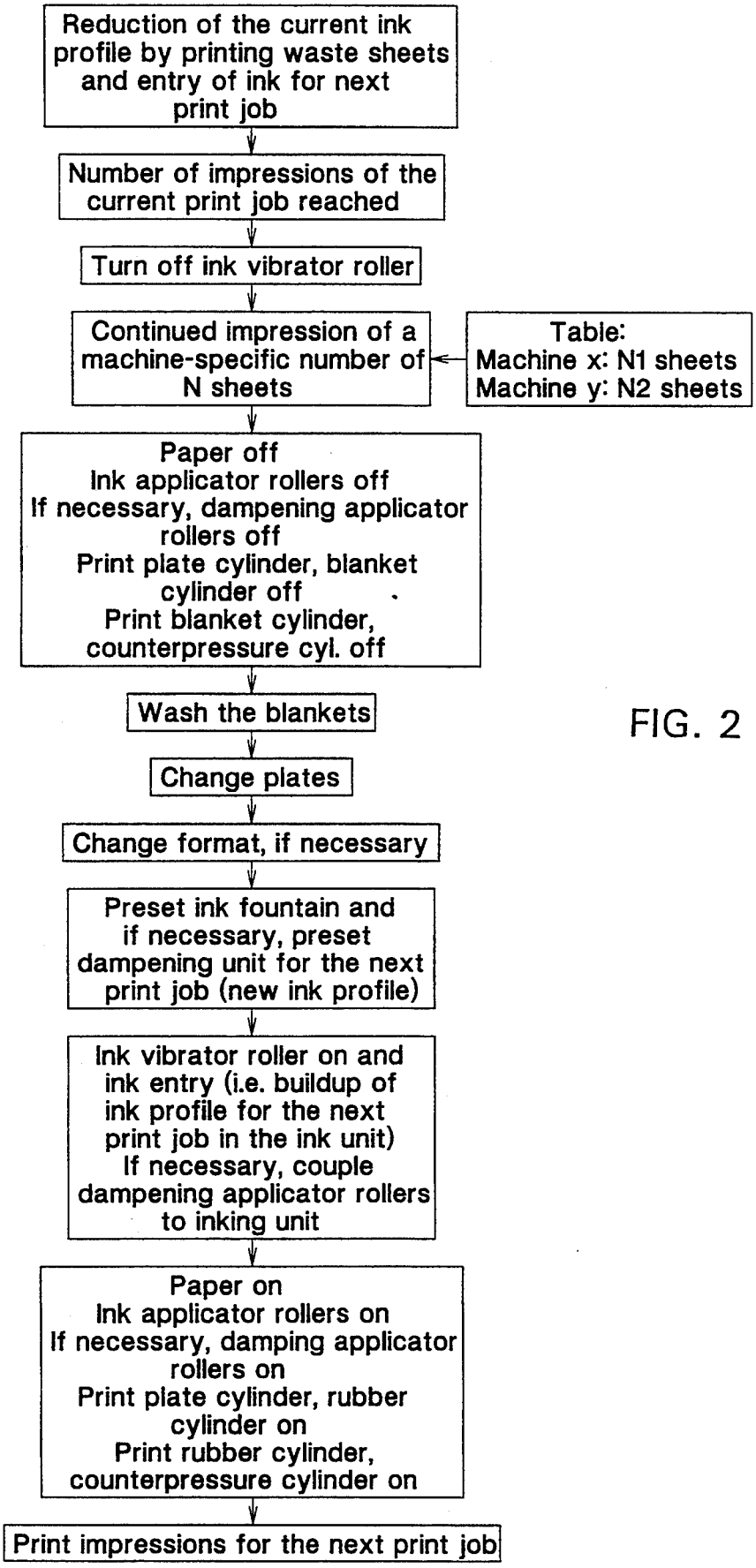
FIG. 2 is flow chart of a process according to a first embodiment of the present invention.
Figure 3:
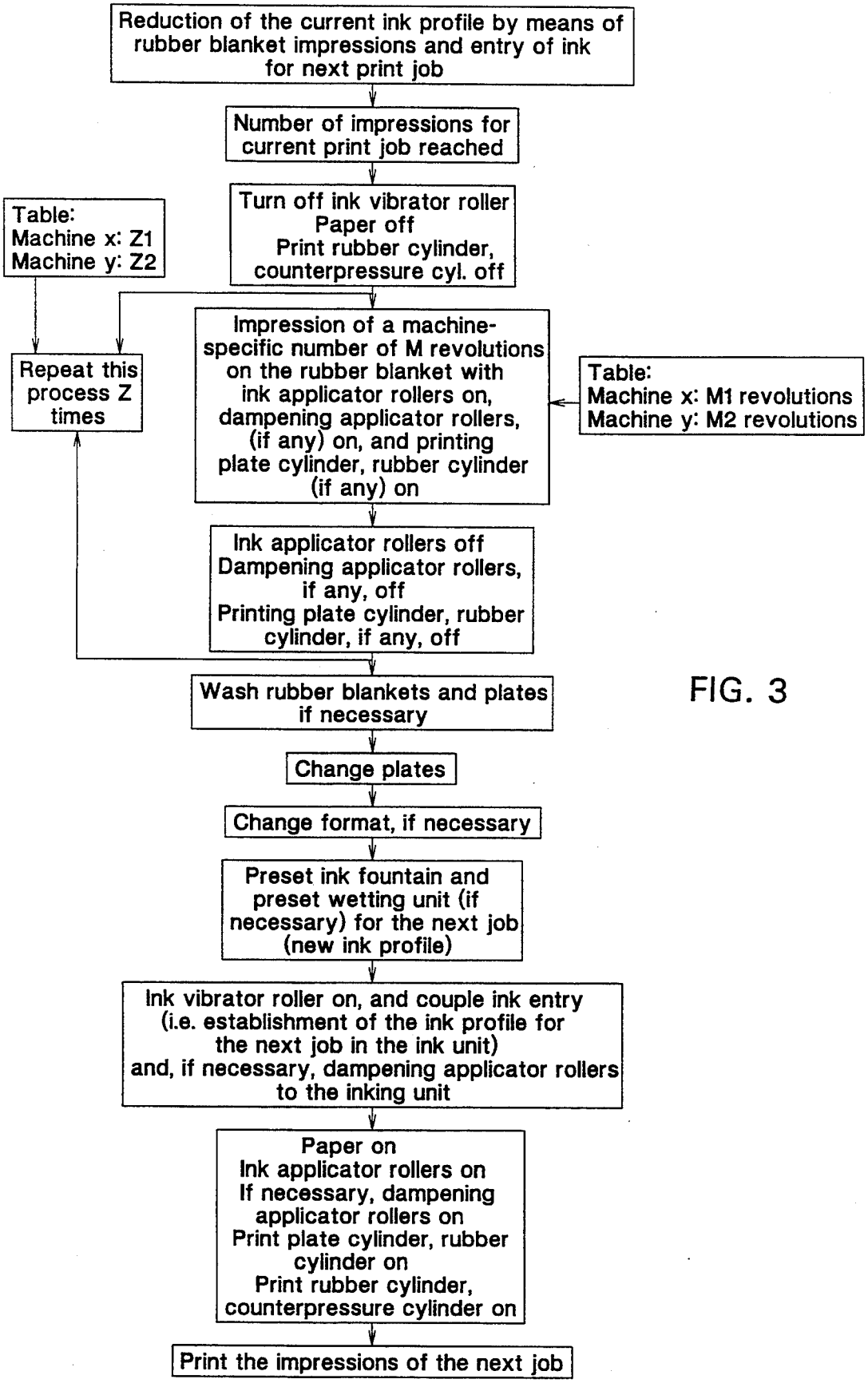
FIG. 3 is flow chart of a process according to an alternative embodiment of the present invention.

In view of the apparatus as discussed above, the process in accordance with the present invention and as outlined in FIGS. 2 and 3, could preferably be carried out as discussed further herebelow.

For many printers, the printer will typically need to conduct one printing immediately after a previous printing is completed. However, each printing operation will typically require different ink distribution along the width of the printing press, in accordance with the density of ink which is needed for each ink zone. As discussed above, the ink distribution in each ink zone is established by means of ink metering ducts 22, wherein there can typically be one metering duct 22 for each ink zone. Therefore, for conducting a printing, each metering duct will typically be adjusted to the amount of ink needed in each ink zone.

For an initial printing, that is from a cleaned printing unit, the first stage of operation could therefore be considered to be the production of the ink zone profile. The initial adjustment can preferably take place without the printing of sheets. In one mode of operation, this adjustment stage could involve at least the following steps, setting the ink metering ducts, and initiating operation of each of: the plate cylinder 11, the inking rollers of the inking unit 12, the ink transfer roller, or vibrator roller 24, and the ink fountain roller 23. The ink from the ink duct 2 can then be transported out of the ink duct 2, through at least one of the plurality of metering ducts 22, to the ink fountain roller 23, to the vibrator roller 24, to the inking rollers of the ink unit 12, and to the plate cylinder 11.

Once an ink profile has been substantially established, the impression can be thrown on (that is, the blanket cylinder 16 and sheet drum 15 can be engaged to the plate cylinder 11), and a few test prints can preferably be run to check the ink profile. Then, if any final adjustments need to be made, such adjustments could be made at this juncture.

Printing of the print job could then be carried out. Such a printing could involve at least starting the feed of sheets into the printing unit 10, from the sheet feeder 27 to the sheet drum 15, transferring an ink image from the plate cylinder 11 to the blanket cylinder 16, and then transferring the ink from the blanket cylinder 16 to the sheet 14 on the sheet drum 15. The sheet could then be conducted through additional inking units (not shown, but essentially similar to the unit 10 depicted) for receiving printings of additional ink colors thereon.

Figure 1B:
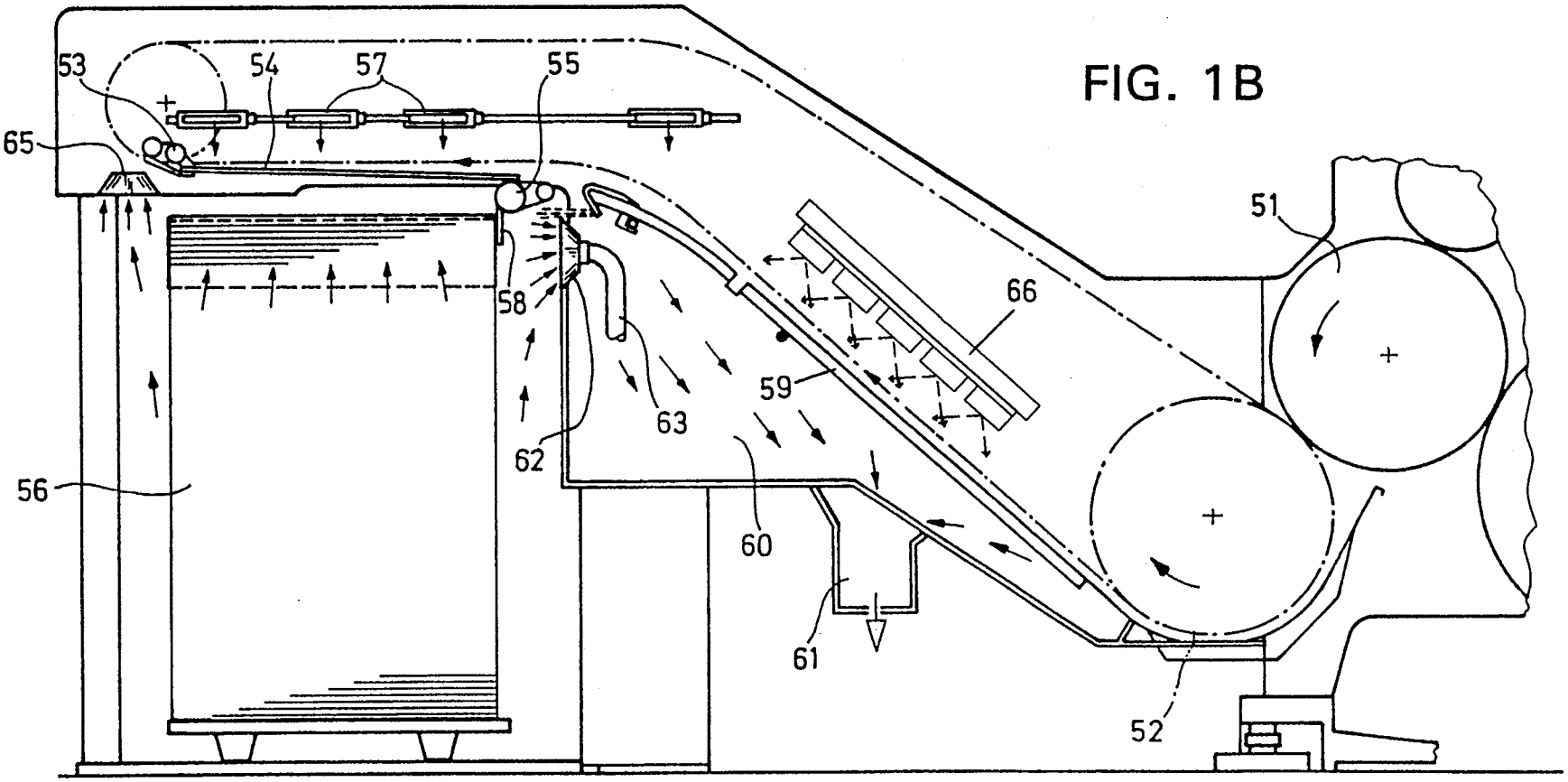
FIG. 1B is a schematic illustration of a drying and stacking unit of a rotary offset printing press.

After the sheets 14 are printed, as depicted in FIG. 1B, the sheets can be transferred to a drying and stacking unit. In such a drying and stacking unit the printed sheets 54 can preferably be passed from an impression cylinder 51 to a chain conveying system 52 on which are disposed a plurality (only one shown) of gripping bridges 53 for conveying the printed sheets 54. Below the chain conveying system 52, a sheet guiding device 59 can be provided for guiding the sheet to the delivery pile 56. In the vicinity of the delivery pile 56, a suction roller 55 can be provided to decelerate the trailing end of the sheet 54, while blowers 57 can be provided thereabove to accelerate deposition of the sheets onto the delivery pile 56. Below the guidance device 59, a suction chamber 60 can preferably be provided, which chamber 60 can be connected to a suction device (not shown) via a connection 61. In addition, a number of additional suction ports and connections 62, 63 and 65, can be provided to provide air flow through the drying and stacking device which can facilitate the stacking of the printed sheets 54.

As the printed sheets 54 are being conveyed along the guiding device 59, the printed sheets 54 can preferably pass below a drying device 66. Such a drying device 66 could in essence, be a simple air-blower, or preferably could be an infra-red or ultra-violet drying system.

When sufficient sheets have been printed, the printing can be terminated, possibly by simply shutting down the entire unit 10, or in accordance with the present invention, providing some sort of changeover operation. If a second print job is to be made immediately thereafter, which second print job is different from the preceding print job, the ink zone profile would generally need to be adjusted from the previous profile to the profile needed for the subsequent print job.

To changeover to another printing job, the ink profile of the first print job essentially needs to be at least partially eliminated, that is, the amount of ink present in the inking unit, etc., from the previous job, preferably needs to be at least partially removed, or reduced down to what could be considered to be a base ink distribution thickness, and then the next ink profile for the subsequent print job would essentially need to be built up. In accordance with one embodiment of the present invention, such an ink distribution changeover can take place as outlined in FIG. 2.

In the embodiment outlined in FIG. 2, the changing of the ink profile can essentially be initiated by reducing the previous ink profile by printing a number of waste sheets with the vibrator roller 24 disengaged, thereby essentially preventing entry of additional ink into the inking unit 12. Thus, when the number of prints for the pending print job is reached, the vibrator roller can be turned off, or disengaged. With the vibrator roller disengaged, a number of addition sheets, waste sheets, for example, could preferably be printed to remove at least a portion of the ink remaining in the inking unit and reduce the ink profile, preferably to a base ink layer thickness.

Once a specified number of "waste sheets" has been printed, which number can be estimated based on references charts and experience as discussed further herebelow, the paper run can be stopped, and the impression can be thrown off. In other words, at least the following parts of the printing unit 10 can be disengaged, or turned off: the ink applicator rollers of the inking unit 12; if necessary, the dampening applicator rollers of the dampening unit 18; the plate cylinder 11, the blanket cylinder 16, and the counterpressure cylinder or sheet drum 15.

If the blanket 17 on the blanket cylinder 16 does not need to be replaced, the blanket cylinder 17 can then be washed, preferably by means of some sort of washing apparatus, such as the washing apparatus 38. The washing apparatus can be engaged with the blanket 17 on the blanket cylinder 16 and a wash cycle can be initiated. To save time, while the blanket 17 is being washed, it might be preferable to change the printing plate from the plate for the previous print job to the plate for the subsequent print job. In essence, the changing of the printing plate could be performed at any time subsequent to the the disengagement or shut down of the press drive 25, that is, prior to, or subsequent to, the washing of the blanket 17.

In addition, at some point during the ink reduction steps as provided hereabove, that is, after the vibrator roller has been disengaged, the ink metering devices 22 can be adjusted to the settings needed for the next print job. In essence, such adjustments could possibly be performed when the waste sheets are being printed, possibly when the blanket 17 is being washed, or possibly, time permitting, even subsequent to the washing of the blanket 17.

At this juncture, any additional changes could also be made to the printing press to prepare the press for the next print job. For example, the sheet feeder, and other paper handling apparatus could be adjusted for a different sheet size, or thickness etc., and the dampening unit 18 could also be adjusted, if necessary, for the new print job.

The build-up of the new ink profile could then be initiated, by turning on, or engaging at least the following components: the inking rollers of the inking unit 12, the ink vibrator roller to carry ink from the ink duct roller 23 to a first ink applicator roller 32 of the inking unit 12, and, if necessary, the dampening applicator rollers of the dampening unit 19 can be coupled to the inking unit to transfer dampening fluid to the inking unit. After a number of revolutions of the inking unit rollers, the new ink profile will essentially be established, and the printing unit 10 would typically be ready for printing the new print job.

To begin printing, the impression can be thrown on, and the feed of sheets can be started. In other words, the ink applicator rollers can be engaged with the plate cylinder, the blanket cylinder can be engaged with the plate cylinder, and the counterpressure cylinder, or sheet drum, can be engaged with the blanket cylinder, the damping unit can be activated, if necessary, and not already operating, and the paper feed can be turned on. The ink from the applicator rollers 13 can then be transferred to the plate cylinder, the plate cylinder can print on the blanket cylinder, and the blanket cylinder can transfer the ink to the sheet on the drum cylinder, to thereby print the next print job.

For the ink removal stage as set forth above, a specific number of "waste sheets" can be printed to remove ink from the inking unit 12. It should generally be understood that the number of waste sheets which need to be printed can vary depending on a number of factors. Such factors, could include at least the following: the viscosity of the ink being used, the color of the ink, the brand or type of ink being used, the actual ink distribution itself, i.e., the thickness of ink present on the rollers, the type of printing stock (paper) being used, temperature, humidity, etc., and even the quality of the print job, wherein, ink jobs demanding a higher print quality may require that the previous profile be completely removed, while jobs which may be able to be printed at lesser quality can allow for some of the previous profile to be left on the rollers.

The determination of the number of "waste sheets" to print can preferably be done by referring to charts, tables, etc., or can often even be done by experience, as an operator who has conducted several such operations could readily know how many waste sheets to print. In this regard, the manufacturer of printing presses could supply reference tables for establishing the number of waste sheets which need to be printed in accordance with at least some of the above-mentioned factors. Alternatively, individual print shops could develop their own tables based on experience and actual changeover cycles. For practical purposes, the number of waste sheets which must be printed could be about 15 sheets. However, as discussed above, this number could vary depending on several factors, and could ultimately range from possibly about 10 sheets to possibly about 20 sheets, with more or less sheets as deemed necessary by the press operator.

In addition to the above profile changeover, FIG. 3 provides an additional alternative procedure for changing the ink profile. In essence, the primary difference between the embodiments illustrated in FIGS. 2 and 3 is that the embodiment of FIG. 3, as discussed immediately herebelow, does not involve printing of waste sheets, but instead substantially relies upon merely printing on the blanket 17 of the blanket cylinder, and then washing the blanket cylinder as needed.

As depicted in FIG. 3, the changing of the ink profile can essentially be initiated, when the current print job is finished, by at least: turning off, or disengaging the vibrator roller; stopping the feed of paper into the unit 10, and disengaging the counter pressure cylinder, or sheet drum 15 from the blanket cylinder 16.

Then, instead of printing sheets as discussed above, with the vibrator roller disengaged, prints can made onto only the blanket cylinder to remove at least a portion of the ink remaining in the inking unit and thereby reduce the ink profile, preferably to a base ink layer thickness.

Once a specified number of prints have been printed on the blanket cylinder, corresponding to a specified number of revolutions of the blanket cylinder in conjunction with the plate cylinder, which number can be estimated based on reference charts and experience as discussed above, the impression can be thrown off. In other words, at least the following parts of the printing unit 10 can be disengaged: the ink applicator rollers of the inking unit 12 can preferably be disengaged from the blanket cylinder, the blanket cylinder can be disengaged from the plate cylinder; and if necessary, the dampening applicator rollers of the dampening unit 18 can be disengaged.

At least the blanket cylinder 17 can then be washed, preferably by means of some sort of washing apparatus, such as the washing apparatus 38. The washing apparatus can be engaged with the blanket 17 on the blanket cylinder 16 and a wash cycle can be initiated. If desired, the plate cylinder could also preferably be washed at the same time, while alternatively, instead of disengaging the plate cylinder from the applicator rollers, the plate cylinder and applicator rollers could be left engaged to transfer additional ink from the inking unit to at least the plate cylinder. After a washing of at least the blanket cylinder is done, the blanket cylinder, plate cylinder and applicator rollers can all be re-engaged to transfer additional ink to the blanket cylinder. Again, after a specified number of revolutions, at least the blanket cylinder could be washed.

As indicated above, the number of print made onto the blanket cylinder could be determined via reference charts, operator experience, etc. In possible embodiments of the present invention, it may be advantageous to print between about 5 to about 15 prints on the blanket cylinder and then wash the blanket cylinder. Alternatively, depending on the conditions as discussed previously, the number of prints could be more or less than the range indicated above.

Such a printing/washing process would typically be carried out a specified number of times, wherein the number of repetitions could be predetermined by way of operator experience, or additional tables or charts as discussed above. In possible embodiments of the present invention, it may be advantageous to repeat the above printing/washing process about 3 to about 6 times. Alternatively, depending on the conditions as discussed previously, the number of repetitions could be more or less than the range indicated above.

Once the printing/washing process is complete, that is, when the ink layer has been reduced to the base layer, the printing plate can be replaced with the plate for the new print job.

In addition, at some point during the ink reduction steps as provided hereabove, that is, after the vibrator roller has been disengaged, the ink metering devices 22 can be adjusted to the settings needed for the next print job. In essence, such adjustments could possibly be performed when the printing/washing cycle of the blanket 17 is being carried out. Alternately, such adjustments could be carried out after the ink profile has been completely reduced.

At this juncture, any additional changes could also be made to the printing press to prepare the press for the next print job. For example, the sheet feeder, and other paper handling apparatus could be adjusted for a different sheet size, or thickness etc., and the dampening unit 18 could also be adjusted, if necessary, for the new print job.

The build-up of the new ink profile could then be initiated, in essentially the same manner as discussed previously. That is, by turning on, or engaging at least the following components: the inking rollers of the inking unit 12, the ink vibrator roller to carry ink from the ink duct roller 23 to a first ink applicator roller 32 of the inking unit 12, and, if necessary, the dampening applicator rollers of the dampening unit 19 can be coupled to the inking unit to transfer dampening fluid to the inking unit. After a number of revolutions of the inking unit rollers, the new ink profile will essentially be established, and the printing unit 10 would typically be ready for printing the new print job.

To begin printing, the impression can be thrown on, and the feed of sheets can be started. In other words, the ink applicator rollers can be engaged with the plate cylinder, the blanket cylinder can be engaged with the plate cylinder, and the counterpressure cylinder, or sheet drum, can be engaged with the blanket cylinder, the damping unit can be activated, if necessary, and not already operating, and the paper feed can be turned on. The ink from the applicator rollers 13 can then be transferred to the plate cylinder, the plate cylinder can print on the blanket cylinder, and the blanket cylinder can transfer the ink to the sheet on the drum cylinder, to thereby print the next print job.

One feature of the invention resides broadly in the process for the defined production of an ink distribution appropriate to a production run in an inking unit of a rotary printing machine when changing jobs, characterized by the following process steps:

upon completion of the print job the vibrator roller of the inking unit is disengaged, impression is thrown on, paper travel is started, and a few prints are produced, paper run is stopped, impression is thrown off, the blanket is cleaned, and the printing plate of the preceding print job is replaced by the printing plate for the new print job, the vibrator roller is engaged, and the ink enters the inking unit, with the respective rollers being thrown off, thereafter impression is thrown on, and paper run is started for the new print job.

Another feature of the invention resides broadly in the process characterized in that, in a rotary offset printing machine, the plate cylinder is supplied with dampening medium upon completion of a print job, with the vibrator roller engaged after the ink has entered the inking unit, and that the cycle of the dampening vibrator roller is activated such that the cycles of the ink vibrator and the dampening vibrator end simultaneously at the end of the ink entry.

Yet another feature of the invention resides broadly in the process characterized in that, upon completion of a print job, with the vibrator roller being disengaged, respective rollers are thrown on, and a few prints are produced on the blanket, and that thereafter the respective rollers are thrown off, and the blanket is cleaned, whereby this procedure may be repeated, if necessary.

Still another feature of the invention resides broadly in the process characterized in that the control system of the process steps is carried out in the printing machine with one command.

Several other processes for providing an ink profile, which could be at least partially used in conjunction with the present invention could possibly include at least some of the process steps as provided by the following documents: U.S. Pat. No. 4,660,470, entitled "Inking Unit Pre-Adjustment Method" and issued Apr. 28, 1987; the published technical papers "Possibilities and Margins of the Computerized Analysis of Offset Inking Units (I)", Prof.Dr.-Ing. Helmut Rech, druck print 8/1984, pp. 522–523; "Possibilities and Margins of the Computerized Analysis of Offset Inking Units (II)", Prof.Dr.-Ing. Helmut Rech, druck print 9/1984, pp. 578–582; "Possibilities and Margins of the Computerized Analysis of Offset Inking Units (III)", Prof.Dr.-Ing. Helmut Rech, druck print 10/1984, pp. 659–660; "Possibilities and Margins of the Computerized Analysis of Offset Inking Units (IV)", Prof.Dr.-Ing. Helmut Rech, druck print 11/1984, pp. 725–726; and "Rechnergesttzte Entwicklung von Farbwerken in Druckmaschinen", Prof.Dr.-Ing. Helmut Rech, Der Polygraph 9, 1981, pp. 699–709 discuss the use of computer assisted iterative simulations, modelings, and empirical or semi-empirical methods for establishing ink transfer characteristics and parameters in rotary printing presses; Issued U.S. Pat. No. 4,441,819 (issued Apr. 18, 1984) and issued U.S. Pat. No. 3,958,509 (issued May 25, 1976), issued European Patent No. 0 081 739, published European Patent Appln. No. 0 095 606 and the prior published technical documents "Flow of Information in the System" "Description of Commands, Store", "Description of Commands, Zones Identical-Gradual Adjustment", "Description of Commands, Cassette: Read In" and "Heidelberg CPC" (Publication No. HN 2/43.e), all of which have been previously published by Heidelberger Druckmaschinen AG, D-6900 Heidelberg, Federal Republic of Germany, discuss the use of a control stand computer to control the printing process and methods by which appropriate ink zone settings and appropriate ink strip lengths may be chosen, preset into the control stand computer, and/or adjusted during the printing process; U.S. Pat. No. 3,771,446 (issued in November, 1973), U.S. Pat. No. 3,965,819 (issued in June, 1976), and U.S. Pat. No. 4,655,135 (issued in April, 1987), U.S. Pat. No. 4,782,756 (issued in November, 1988).

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if any, described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 12 229.9 filed on Apr. 14, 1993, having inventors Nikolaus Pfeiffer and Manfred Schneider, and DE-OS P 43 12 229.9 and DE-PS p 43 12 229.9, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A process for operating a printing press comprising a printing plate cylinder for positioning a printing plate, an ink reservoir for holding a supply of ink and an inking mechanism for transferring the ink between the ink reservoir and the printing plate during operation of the printing press, the inking mechanism comprising a plurality of inking rollers, a plurality of individually adjustable ink zone metering devices disposed in conjunction with the ink reservoir, at least one ink fountain roller positioned adjacent the plurality of individually adjustable ink zone metering devices to receive ink via the metering devices, and at least one ink transfer roller for transferring ink between the ink fountain roller and at least one of the plurality of inking rollers, each of the plurality of individually adjustable ink zone metering devices defining a substantially corresponding ink zone in the printing press, the printing press further comprising sheet feeding means for feeding sheets of printing stock into the printing press, a rubber blanket cylinder having a rubber blanket disposed thereabout for receiving an ink impression from the plate cylinder, a sheet drum for receiving sheets being fed for printing the ink impression of the rubber blanket onto the sheets, means for stacking printed sheets in a pile, and means for transporting printed sheets to the sheet stacking means, said process comprising the steps of: adjusting the plurality of ink zone metering devices to settings appropriate for establishing a first ink zone profile in the printing press; transferring ink from the ink reservoir to the printing plate cylinder via a route of travel which extends from the ink reservoir through at least one of the plurality of individually adjustable ink zone metering devices, thereafter to the at least one ink fountain roller, thereafter to the at least one ink transfer roller, thereafter to the plurality of inking rollers, and thereafter to the printing plate cylinder to establish the first ink zone profile; feeding sheets of printing stock for the first printing job into the printing press to the sheet drum with the sheet feeding means; engaging the rubber blanket cylinder with the plate cylinder; positioning the sheet drum adjacent the rubber blanket cylinder; transferring ink impressions from the printing plate to the rubber blanket cylinder and then to sheets of printing stock on the sheet drum to produce printed sheets; transporting the printed sheets from the sheet drum to the sheet stacking means with the sheet transport means; stacking the printed sheets into a pile of sheets; terminating the printing of the first printing job; changing over the printing press from the first printing job to the second printing job, the second printing job having an ink zone profile different from the first ink zone profile, and at least the plurality of inking rollers having a residual amount of ink thereon after terminating the first printing job, said changeover process comprising the steps of: interrupting flow of ink from the ink reservoir to the plurality of inking rollers; operating at least the plurality of inking rollers, the plate cylinder and the rubber blanket cylinder to transfer residual ink from the inking rollers to the rubber blanket cylinder; removing residual ink from the blanket cylinder; repeating said steps of operating and removing to remove a substantial portion of the residual ink from at least the plurality of inking rollers; removing the printing plate from the first print job and installing a printing plate for the next print job; adjusting the plurality of ink zone metering devices to settings appropriate for establishing the second ink zone profile of the second printing job; and operating the plurality of inking rollers, the at least one ink transfer roller, and the at least one ink fountain roller to transfer ink from the ink reservoir to the inking rollers to establish the second ink zone profile in the printing press; feeding sheets of printing stock for the second printing job into the printing press to the sheet drum with the sheet feeding means; engaging the plate cylinder with the plurality of inking rollers, engaging the rubber blanket cylinder with plate cylinder, and operating the sheet drum in conjunction with the rubber blanket cylinder; transferring ink from the plurality of inking rollers to the printing plate on the plate cylinder to form ink impressions on the printing plate, transferring ink impressions from the printing plate to the rubber blanket cylinder and then from the rubber blanket cylinder to sheets of printing stock on the sheet drum to produce printed sheets; transporting the printed sheets from the sheet drum to the sheet stacking means with the sheet transfer means; stacking the printed sheets into a pile of printed sheets; and terminating the printing of the second printing job.

2. The process according to claim 1, wherein said repeating of said steps of operating and removing comprises removing the residual ink until said plurality of rollers have a predetermined thickness of a base layer of ink remaining thereon.

3. The process according to claim 2, wherein said removing of at least a portion of the residual ink from the blanket cylinder comprises at least one of: transferring the residual ink on the blanket cylinder to a sheet of printing stock; and washing the blanket cylinder to wash the residual ink off of the blanket cylinder.

4. The process according to claim 3, wherein, after said interrupting of the flow of ink, said process comprises: operating at least the plurality of inking rollers, the plate cylinder, the rubber blanket cylinder, the sheet feed means and the sheet drum means to transfer at least a portion of the residual ink from the plurality of inking rollers to sheets of printing stock on the sheet drum means to print a predetermined number of printed sheets; interrupting feed of sheets of printing stock into the printing press; disengaging the plurality of inking rollers from the plate cylinder; disengaging the rubber blanket cylinder from the plate cylinder; disengaging the sheet drum means from the blanket cylinder; washing the blanket cylinder to remove residual ink from the blanket cylinder; and one of: conducting said changing of the printing plates during said washing; and conducting said changing of the printing plates subsequent to said washing.

5. The process according to claim 4, wherein: the at least one ink transfer roller comprises a vibrator roller for transferring ink from the ink fountain roller to the at least one of the plurality of inking rollers said step of interrupting ink flow comprises interrupting operation of the ink vibrator roller to interrupt the flow of ink from the ink fountain roller to at least one of the plurality of inking rollers; and, after said adjusting of the plurality of ink zone metering devices to settings appropriate for establishing the second ink zone profile of the second printing job, said process comprises operating the plurality of inking rollers, and the ink vibrator roller to transfer ink from the ink fountain roller to the at least one roller, and from the at least one roller to other rollers of the plurality of inking rollers to establish the second ink zone profile on the plurality of inking rollers.

6. The process according to claim 5, wherein: the printing press comprises a rotary printing press;

said predetermined thickness of ink comprises between about 3 to about 7 microns; said predetermined number of printed sheets comprises about 10 to about 20 printed sheets;

the rotary printing press further comprises means for applying dampening fluid to at least one of:
the plate cylinder, and
the plurality of inking rollers, said means for applying dampening fluid comprises a dampening vibrator roller, and printing with the rotary printing press further comprises transferring dampening fluid from a dampening fluid reservoir to the at least one of: the plate cylinder, and the plurality of inking rollers with said dampening vibrator roller;

the vibrator roller for transferring ink operates on a repetitive cycle into and out of engagement with the plurality of inking rollers, and the dampening vibrator roller operates on a repetitive cycle into and out of engagement with the at least one of: the plate cylinder and the plurality of inking rollers;

the cycles for both the dampening vibrator roller and the vibrator roller for transferring ink are coordinated to end simultaneously and out of engagement with the plurality of inking rollers;

the printing press is operated by control means, the control means comprising input means for inputting commands to operate the printing press, and said process further comprises inputting a single command to conduct the entire changeover process;

said step of washing comprises washing with washing apparatus disposed adjacent the blanket cylinder, the washing apparatus comprising: at least one roller means for introducing washing medium onto the blanket cylinder; means for providing washing medium onto the at least one roller means; means for moving the at least one roller means into engagement with the blanket cylinder; and means for removing washing medium from the at least one roller means.

7. The process according to claim 3, wherein after said interrupting of the flow of ink, said process comprises: interrupting feed of sheets of printing stock into the printing press; disengaging the sheet drum means from the blanket cylinder; operating at least the plurality of inking rollers, the plate cylinder, and the rubber blanket cylinder, to transfer at least a portion of the residual ink from the plurality of inking rollers to the rubber blanket cylinder to print a predetermined number of prints onto the rubber blanket cylinder; disengaging the plurality of inking rollers from the plate cylinder; disengaging the rubber blanket cylinder from the plate cylinder; washing at least the blanket cylinder to remove residual ink from the blanket cylinder; re-engaging the plurality of inking rollers with the plate cylinder and re-engaging the rubber blanket cylinder with the plate cylinder; and repeating, a predetermined number of times, said steps of operating, disengaging and washing until the base layer thickness is attained on the plurality of inking rollers.

8. The process according to claim 7, wherein the at least one ink transfer roller comprises a vibrator roller for transferring ink from the ink fountain roller to the at least one of the plurality of inking rollers, and said process further comprising:

said step of interrupting ink flow comprising interrupting operation of the ink vibrator roller to interrupt the flow of ink from the ink fountain roller to at least one of the plurality of inking rollers; and after said adjusting of the plurality of ink zone metering devices to settings appropriate for establishing the second ink zone profile of the second printing job, said process comprising operating the plurality of inking rollers, and the ink vibrator roller to transfer ink from the ink fountain roller to the at least one roller, and from the at least one roller to other rollers of the plurality of inking rollers to establish the second ink zone profile on the plurality of inking rollers.

9. The process according to claim 8, wherein: the printing press comprises a rotary printing press;

said predetermined thickness of ink comprises between about 3 to about 7 microns;

said predetermined number of prints on the blanket cylinder comprises about 5 to about 15 prints;

said predetermined number of repetitions comprises about 3 to about 6 repetitions;

the rotary printing press further comprises means for applying dampening fluid to at least one of:
the plate cylinder, and
the plurality of inking rollers, said means for applying dampening fluid comprises a dampening vibrator roller, and printing with the rotary printing press further comprises transferring dampening fluid from a dampening fluid reservoir to the at least one of: the plate cylinder, and the plurality of inking rollers with said dampening vibrator roller;

the vibrator roller for transferring ink operates on a repetitive cycle into and out of engagement with the plurality of inking rollers, and the dampening vibrator roller operates on a repetitive cycle into and out of engagement with the at least one of: the plate cylinder and the plurality of inking rollers;

the cycles for both the dampening vibrator roller and the vibrator roller for transferring ink are coordinated to end simultaneously and out of engagement with the plurality of inking rollers;

the printing press is operated by control means, the control means comprising input means for inputting commands to operate the printing press, and said process further comprises inputting a single command to conduct the entire changeover process;

said step of washing comprises washing with washing apparatus disposed adjacent the blanket cylinder, the washing apparatus comprising: at least one roller means for introducing washing medium onto the blanket cylinder; means for providing washing medium onto the at least one roller means;means for moving the at least one roller means into engagement with the blanket cylinder; and means for removing washing medium from the at least one roller means.

10. A process for operating a printing press comprising: a printing plate cylinder for positioning a printing plate, an ink reservoir for holding a supply of ink and an inking mechanism for transferring the ink between the ink reservoir and the printing plate during operation of the printing press, the inking mechanism comprising a plurality of inking rollers, a plurality of individually adjustable ink zone metering devices disposed in conjunction with the ink reservoir, and means for transferring ink between the ink zone metering device and at least one of the plurality of inking rollers, each of the plurality of individually adjustable ink zone metering devices defining a substantially corresponding ink zone in the printing press, the first printing job having a first ink profile, and the second printing job having a second second ink profile, said process comprising changing of the ink profile from the first ink profile to the second ink profile, and said changing of the ink profile comprising the steps of: printing a first print job; finishing the printing of the first printing job, at least said plurality of inking rollers having a residual amount of ink thereon after said terminating of the first printing job; interrupting flow of ink from the ink reservoir to the plurality of inking rollers; operating at least the plurality of inking rollers, the plate cylinder and the rubber blanket cylinder to transfer at least a portion of the residual ink from the plurality of inking rollers to the rubber blanket cylinder; removing at least a portion of the residual ink from the blanket cylinder; repeating said steps of operating and removing to remove a substantial portion of the residual ink from at least the plurality of inking rollers; changing printing plates by removing a printing plate from the first printing job and installing a printing plate for the second printing job; adjusting the plurality of ink zone metering devices to settings appropriate for establishing a second ink zone profile of the second printing job; operating the plurality of inking rollers, and the means for transferring ink to transfer ink from the plurality of ink zone metering devices to the plurality of inking rollers to establish the second ink zone profile on the plurality of inking rollers; engaging the plate cylinder with the plurality of inking rollers to transfer ink from the plurality of inking rollers to the printing plate to form an ink impression on the printing plate; and printing said second print job.

11. The process according to claim 10, wherein said repeating of said steps of operating and removing comprises removing the residual ink until said plurality of rollers have a predetermined thickness of a base layer of ink remaining thereon.

12. The process according to claim 11, wherein said removing of at least a portion of the residual ink from the blanket cylinder comprises at least one of: transferring the residual ink on the blanket cylinder to a sheet of printing stock; and washing the blanket cylinder to wash the residual ink off of the blanket cylinder.

13. The process according to claim 12, wherein the printing press further comprises sheet feeding means for feeding sheets of printing stock into the printing press and sheet drum means for receiving sheets of printing stock from the sheet feed means and positioning sheets of printing stock for printing thereon by the rubber blanket cylinder, and after said interrupting of the flow of ink, said process comprises:

operating at least the plurality of inking rollers, the plate cylinder, the rubber blanket cylinder, the sheet feed means and the sheet drum means to transfer at least a portion of the residual ink from the plurality of inking rollers to sheets of printing stock on the sheet drum means to print a predetermined number of printed sheets;

interrupting feed of sheets of printing stock into the printing press;

disengaging the plurality of inking rollers from the plate cylinder;

washing the blanket cylinder to remove residual ink from the blanket cylinder; and one of:

conducting said changing of the printing plates during said washing; and conducting said changing of the printing plates subsequent to said washing.

14. The process according to claim 13, wherein said means for transferring ink from the ink reservoir to the plurality of inking rollers comprises an ink vibrator roller for receiving ink passing through the plurality of ink zone metering devices and transferring the ink to at least one roller of said plurality of inking rollers, and said process further comprising:

said step of interrupting ink flow comprising interrupting operation of the ink vibrator roller to interrupt the flow of ink from the ink reservoir to the plurality of inking rollers; and after said adjusting of the plurality of ink zone metering devices to settings appropriate for establishing the second ink zone profile of the second printing job, said process comprising operating the plurality of inking rollers, and the ink vibrator roller to transfer ink from the plurality of ink zone metering devices to the at least one roller, and from the at least one roller to other rollers of the plurality of inking rollers to establish the second ink zone profile on the plurality of inking rollers.

15. The process according to claim 14, wherein: after said engaging of the plate cylinder with the plurality of inking rollers to transfer ink from the plurality of inking rollers to the printing plate to form ink impressions on the printing plate, said process further comprises:

engaging said rubber blanket cylinder with said plate cylinder to transfer ink impressions from the plate cylinder to the rubber blanket cylinder;

engaging said feed drum means with said rubber blanket cylinder;

operating said sheet feed means to feed sheets of printing stock to said sheet drum means; and printing said second print job by transferring the ink impressions from the rubber blanket cylinder to sheets of printing stock on said sheet drum means.

16. The process according to claim 15, wherein:

the printing press comprises a rotary printing press;

said predetermined thickness of ink comprises between about 3 to about 7 microns;

said predetermined number of printed sheets comprises about 10 to about 20 printed sheets;

the rotary printing press further comprises means for applying dampening fluid to at least one of:

the plate cylinder, and the plurality of inking rollers, said means for applying dampening fluid comprises a dampening vibrator roller, and printing with the rotary printing press further comprises transferring dampening fluid from a dampening fluid reservoir to the at least one of: the plate cylinder, and the plurality of inking rollers with said dampening vibrator roller;

the vibrator roller for transferring ink operates on a repetitive cycle into and out of engagement with the plurality of inking rollers, and the dampening vibrator roller operates on a repetitive cycle into and out of engagement with the at least one of: the plate cylinder and the plurality of inking rollers;

the cycles for both the dampening vibrator roller and the vibrator roller for transferring ink are coordinated to end simultaneously and out of engagement with the plurality of inking rollers;

the printing press is operated by control means, the control means comprising input means for inputting commands to operate the printing press, and said process further comprises inputting a single command to conduct the entire changeover process;

said step of washing comprises washing with washing apparatus disposed adjacent the blanket cylinder, the washing apparatus comprising: at least one roller means for introducing washing medium onto the blanket cylinder; means for providing washing medium onto the at least one roller means; means for moving the at least one roller means into engagement with the blanket cylinder; and means for removing washing medium from the at least one roller means.

17. The process according to claim 12, wherein the printing press further comprises sheet feeding means for feeding sheets of printing stock into the printing press and sheet drum means for receiving sheets of printing stock from the sheet feed means and positioning sheets of printing stock for printing thereon by the rubber blanket cylinder, and after said interrupting of the flow of ink, said process comprises:

interrupting feed of sheets of printing stock into the printing press;

disengaging the sheet drum means from the blanket cylinder;

operating at least the plurality of inking rollers, the plate cylinder, and the rubber blanket cylinder, to transfer at least a portion of the residual ink from the plurality of inking rollers to the rubber blanket cylinder to print a predetermined number of prints onto the rubber blanket cylinder;

disengaging the plurality of inking rollers from the plate cylinder;

disengaging the rubber blanket cylinder from the plate cylinder;

washing at least the blanket cylinder to remove residual ink from the blanket cylinder;

re-engaging the plurality of inking rollers with the plate cylinder and re-engaging the rubber blanket cylinder with the plate cylinder; and repeating, a predetermined number of times, said steps of operating, disengaging and washing until the base layer thickness is attained on the plurality of inking rollers.

18. The process according to claim 17, wherein said means for transferring ink from the ink reservoir to the plurality of inking rollers comprises an ink vibrator roller for receiving ink passing through the plurality of ink zone metering devices and transferring the ink to at least one roller of said plurality of inking rollers, and said process further comprising:

said step of interrupting ink flow comprising interrupting operation of the ink vibrator roller to interrupt the flow of ink from the ink reservoir to the plurality of inking rollers; and after said adjusting of the plurality of ink zone metering devices to settings appropriate for establishing the second ink zone profile of the second printing job, said process comprising operating the plurality of inking rollers, and the ink vibrator roller to transfer ink from the plurality of ink zone metering devices to the at least one roller, and from the at least one roller to other rollers of the plurality of inking rollers to establish the second ink zone profile on the plurality of inking rollers.

19. The process according to claim 18, wherein: after said engaging of the plate cylinder with the plurality of inking rollers to transfer ink from the plurality of inking rollers to the printing plate to form ink impressions on the printing plate, said process further comprises:

engaging said rubber blanket cylinder with said plate cylinder to transfer ink impressions from the plate cylinder to the rubber blanket cylinder;

engaging said feed drum means with said rubber blanket cylinder;

operating said sheet feed means to feed sheets of printing stock to said sheet drum means; and printing said second print job by transferring the ink impressions from the rubber blanket cylinder to sheets of printing stock on said sheet drum means;

20. The process according to claim 19, wherein:

the printing press comprises a rotary printing press;

said predetermined thickness of ink comprises between about 3 to about 7 microns;

said predetermined number of prints on the blanket cylinder comprises about 5 to about 15 prints;

said predetermined number-of repetitions comprises about 3 to about 6 repetitions;

the rotary printing press further comprises means for applying dampening fluid to at least one of:

the plate cylinder, and the plurality of inking rollers, said means for applying dampening fluid comprises a dampening vibrator roller, and printing with the rotary printing press further comprises transferring dampening fluid from a dampening fluid reservoir to the at least one of: the plate cylinder, and the plurality of inking rollers with said dampening vibrator roller;

the vibrator roller for transferring ink operates on a repetitive cycle into and out of engagement with the plurality of inking rollers, and the dampening vibrator roller operates on a repetitive cycle into and out of engagement with the at least one of: the plate cylinder and the plurality of inking rollers;

the cycles for both the dampening vibrator roller and the vibrator roller for transferring ink are coordinated to end simultaneously and out of engagement with the plurality of inking rollers;

the printing press is operated by control means, the control means comprising input means for inputting commands to operate the printing press, and said process further comprises inputting a single command to conduct the entire changeover process;

said step of washing comprises washing with washing apparatus disposed adjacent the blanket cylinder, the washing apparatus comprising: at least one roller means for introducing washing medium onto the blanket cylinder; means for providing washing medium onto the at least one roller means; means for moving the at least one roller means into engagement with the blanket cylinder; and means for removing washing medium from the at least one roller means.

* * * * *

UNITED STATES PATENT AND TRADEMARK OFFICE

CERTIFICATE OF CORRECTION

PATENT NO. : 5,447,102

DATED : September 5, 1995

INVENTOR(S) : Nikolaus PFEIFFER, et al.

It is certified that error appears in the above-indentified patent and that said Letters Patent is hereby corrected as shown below:

In column 6, line 43, after "throw-off" delete "27" and insert --27'--.

In column 12, lines 47-48, after "and", delete "Rechnergesttzte" and insert --Rechnergestützte--.

Signed and Sealed this

Fourteenth Day of November, 1995

Bruce Lehman

*Attest:*

BRUCE LEHMAN

*Attesting Officer*

*Commissioner of Patents and Trademarks*